US007357652B1

(12) United States Patent
Arenas et al.

(10) Patent No.: US 7,357,652 B1
(45) Date of Patent: Apr. 15, 2008

(54) MODULAR WIRING SYSTEM WITH LOCKING ELEMENTS

(75) Inventors: Alfredo Arenas, Little Neck, NY (US); Leslie Lindenstraus, New York, NY (US); Dennis Oddsen, Eaton's Neck, NY (US); Anthony Tufano, North Massapequa, NY (US)

(73) Assignee: Leviton Manufacturing Company, Inc., Little Neck, NY (US)

( * ) Notice: Subject to any disclaimer, the term of this patent is extended or adjusted under 35 U.S.C. 154(b) by 0 days.

(21) Appl. No.: 11/553,793

(22) Filed: Oct. 27, 2006

(51) Int. Cl.
*H01R 13/648* (2006.01)

(52) U.S. Cl. ..... 439/107

(58) Field of Classification Search ..... 439/107, 439/535, 337, 135
See application file for complete search history.

(56) References Cited

U.S. PATENT DOCUMENTS

| | | | | |
|---|---|---|---|---|
| 1,938,309 | A | 12/1933 | Williams | |
| 2,433,917 | A | 6/1948 | McCartney | |
| 2,515,256 | A | 7/1950 | O'Brien et al. | |
| 3,002,175 | A | 9/1961 | Bertram et al. | |
| 3,038,141 | A | 6/1962 | Chichiolo | |
| 3,156,761 | A | 11/1964 | Schinske | |
| 3,641,472 | A | 2/1972 | Phillips, Jr. | |
| 3,716,651 | A * | 2/1973 | Werner | 174/53 |
| 3,852,513 | A | 12/1974 | Flahive | |
| 3,957,336 | A | 5/1976 | Bromberg | |
| 3,975,074 | A | 8/1976 | Fuller | |
| 4,165,443 | A | 8/1979 | Figart et al. | |
| 4,166,934 | A | 9/1979 | Marrero | |
| 4,245,880 | A * | 1/1981 | Zimmerman et al. | 439/405 |
| 4,273,957 | A | 6/1981 | Kolling, Jr. | |
| 4,295,018 | A * | 10/1981 | Borrelli | 200/51.09 |
| 4,336,418 | A | 6/1982 | Hoag | |
| 4,477,141 | A | 10/1984 | Hardesty | |
| 4,589,719 | A | 5/1986 | Gentry et al. | |
| 4,725,249 | A | 2/1988 | Blackwood et al. | |
| 4,842,551 | A | 6/1989 | Heimann | |
| 4,917,625 | A * | 4/1990 | Haile | 439/358 |
| 5,015,203 | A | 5/1991 | Furrow | |
| 5,043,531 | A | 8/1991 | Gutenson et al. | |
| 5,057,646 | A | 10/1991 | Nichols et al. | |
| 5,117,122 | A | 5/1992 | Hogarth et al. | |
| 5,162,611 | A | 11/1992 | Nichols, III et al. | |
| 5,178,555 | A | 1/1993 | Kilpatrick et al. | |
| 5,185,580 | A | 2/1993 | Nichols, III et al. | |

(Continued)

*Primary Examiner*—Tulsidas C. Patel
*Assistant Examiner*—Vladimir Imas
(74) *Attorney, Agent, or Firm*—Collard & Roe, P.C.

(57) ABSTRACT

A modular wiring system comprising a functional unit and a wiring unit. There is also a system for coupling the functional unit to the wiring unit in a rotational manner. This system can be formed from at least one locking prong comprised of electrically conductive material. When the functional unit is coupled to the wiring unit, the locking prong is both electrically and physically coupled to the functional unit at a first end and to the wiring unit at a second end. Alternatively, or in addition, the system for coupling the functional unit to the wiring unit in a rotational manner can include at least one flange coupled to the functional unit and at least one flange coupled to the wiring unit. These flanges operate such that when the functional unit and the wiring unit are coupled together, they are rotated to form a locking connection between the flange on the functional unit and the flange on the wiring unit.

29 Claims, 13 Drawing Sheets

U.S. PATENT DOCUMENTS 5,190,468 A 3/1993 Nichols, III et al.
D340,912 S 11/1993 Miller
D341,125 S 11/1993 Miller
5,297,973 A 3/1994 Gorman
5,397,929 A 3/1995 Hogarth et al.
5,582,522 A 12/1996 Johnson
5,584,714 A 12/1996 Karst et al.
5,605,466 A * 2/1997 Devlin et al. ..... 439/144
5,785,551 A 7/1998 Libby
5,865,633 A * 2/1999 Hou, Jr. ..... 439/139
5,964,618 A 10/1999 McCarthy
6,028,268 A 2/2000 Stark et al.
6,045,374 A 4/2000 Candeloro
6,071,132 A 6/2000 Cook
6,156,971 A 12/2000 May
6,309,248 B1 10/2001 King
6,328,581 B1 * 12/2001 Lee et al. ..... 439/106
6,341,981 B1 1/2002 Gorman
6,376,770 B1 4/2002 Hyde
6,417,450 B1 * 7/2002 Young ..... 174/66
6,494,728 B1 12/2002 Gorman
6,515,564 B2 * 2/2003 Leopold et al. ..... 335/18
6,558,190 B1 5/2003 Pierson, Jr.
6,563,049 B2 5/2003 May
6,767,245 B2 7/2004 King
6,774,307 B2 8/2004 Kruse et al.
6,817,873 B1 11/2004 Gorman
6,831,226 B2 12/2004 Allen, Jr.
6,843,680 B2 1/2005 Gorman
6,863,561 B2 3/2005 Gorman
6,870,099 B1 3/2005 Schultz et al.
6,876,888 B2 4/2005 Locke
6,884,111 B2 4/2005 Gorman
6,894,221 B2 5/2005 Gorman
6,939,179 B1 * 9/2005 Kieffer et al. ..... 439/650
6,945,815 B1 9/2005 Mullally
6,955,559 B2 10/2005 Pyrros
6,979,212 B1 12/2005 Gorman
6,986,674 B1 1/2006 Gorman
6,994,585 B2 2/2006 Benoit et al.
7,052,313 B2 5/2006 Gorman
7,060,897 B2 6/2006 Gorman
7,081,009 B2 7/2006 Gorman
7,081,010 B2 7/2006 Gorman
7,101,187 B1 9/2006 Deconinck et al.
7,104,836 B1 9/2006 Gorman
7,189,110 B1 * 3/2007 Savicki, Jr. ..... 439/535
2002/0052139 A1 5/2002 Gorman
2002/0055301 A1 5/2002 Gorman
2004/0130218 A1 7/2004 Locke
2004/0206541 A1 10/2004 Locke
2005/0006124 A1 1/2005 Kruse et al.
2005/0070161 A1 3/2005 Dunwoody
2005/0075007 A1 * 4/2005 Benoit et al. ..... 439/536
2005/0250377 A1 11/2005 Gorman
2005/0250378 A1 11/2005 Groman
2005/0272304 A1 12/2005 Gorman
2005/0272305 A1 12/2005 Gorman

* cited by examiner

FIG. 3A
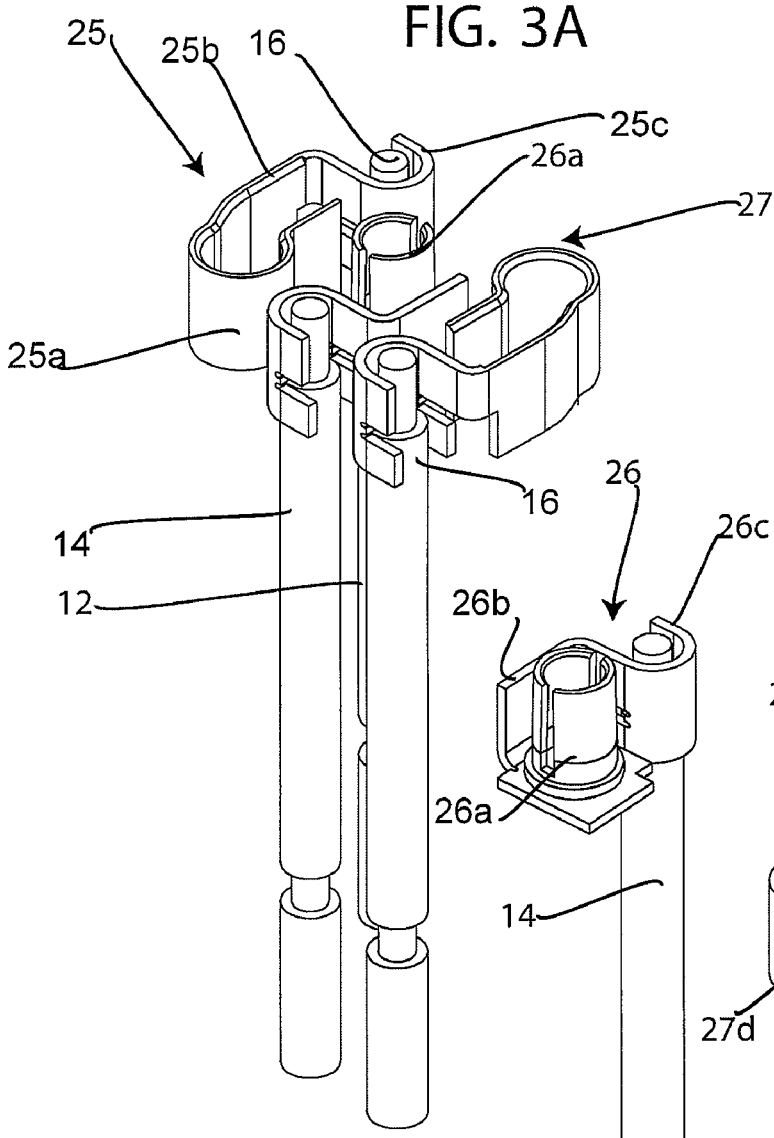
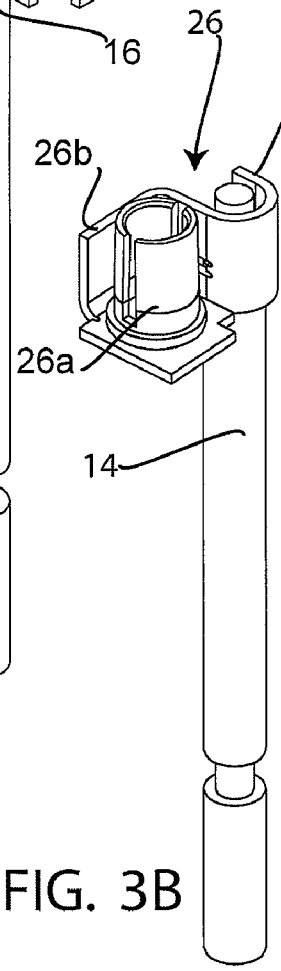
FIG. 3B
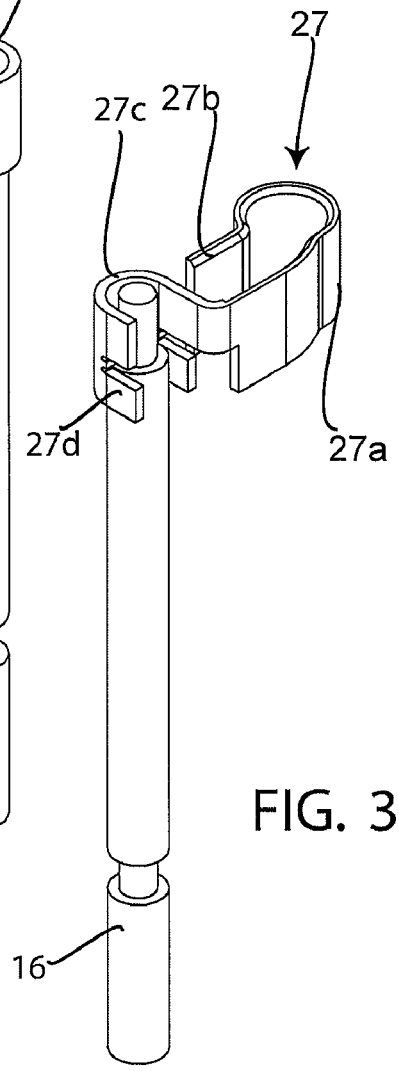
FIG. 3C

MODULAR WIRING SYSTEM WITH LOCKING ELEMENTS

BACKGROUND

The invention relates to a modular wiring system having locking elements. The wiring module comprises a wiring unit and a functional unit. The wiring unit can be for coupling to the ends of wires such as a phase wire, a neutral wire and a ground wire. The functional module can be for example in the form of a receptacle or a light switch. Other types of modular units are known in the art, for example, U.S. Pat. No. 7,052,313 to Gorman, which issued on May 30, 2006, the disclosure of which is hereby incorporated herein by reference in its entirety.

SUMMARY

The invention relates to a modular wiring system comprising a functional unit and a wiring unit. There is also a system for coupling the functional unit to the wiring unit in a rotational manner. This system can be formed from at least one locking element or prong comprised of electrically conductive material. The prong can also be known as a branch, arm, fin, projection, or rod depending on its shape. When the functional unit is coupled to the wiring unit, the locking element or prong is both electrically and physically coupled to the functional unit at a first end and to the wiring unit at a second end. Alternatively, or in addition, the system for coupling the functional unit to the wiring unit in a rotational manner can include at least one flange coupled to the functional unit and at least one flange coupled to the wiring unit. These flanges operate such that when the functional unit and the wiring unit are placed together, they are rotated to form a locking connection between the flange on the functional unit and the flange on the wiring unit.

An example or first embodiment of the invention can include a functional unit comprising a housing, at least one functional interface coupled to the housing, and at least one locking element or prong extending out from the housing. This locking element or prong has a first section forming a base connection section and a second section forming a locking section.

The wiring unit comprises a housing having at least one opening and at least one front face forming a connection interface for the locking section of the locking element or prong.

In one embodiment, this locking element or prong can be in the form of a substantially cylindrically shaped prong made from electrically conductive material. Alternatively, the locking element or prong can be in the form of a plate or curved arm made from electrically conductive material.

This locking element or prong can include a first base section that is smaller in area than the second locking section. The locking section can be in the form of a locking flange which can be used to interact with an inside region of the front face of the housing to lock the functional unit to the wiring unit.

In addition to the locking prongs, there can also be locking flanges, which can be used to couple the functional unit to the wiring unit. For example, both the functional unit and the wiring unit can comprise at least one, or multiple locking flanges, which facilitate the connection of these two units together. In this case, at least one locking flange is in the form of a fixed latch tab. Alternatively, at least one locking flange can be in the form of a latch release tab which functions as a leaf spring.

The functional unit and the wiring unit are coupled to each other in a rotational manner. To facilitate this type of connection, the functional unit further comprises at least one raised surface disposed on its back face. This raised surface is for allowing the wiring unit to couple to the locking element on the functional unit and then rotate on the raised surface.

The wiring unit can be designed such that it has at least one opening wherein the opening can be wider in a first section and then narrower in a second section. In this case, the functional unit includes a locking element prong having a narrower base and a wider end portion. With this design, the first wider receiving region is adapted to receive said wider end portion of the locking element or prong, such that when said wiring unit is put in functional contact with the functional unit, the wider end portion inserts into the wider receiving region. Next, the wiring unit is rotated relative to the functional unit such that the wider end portion on the locking prong rotates into the second narrower locking region on the wiring unit to lock the functional unit to the wiring unit. This locking function occurs when the wider end portion is disposed under the narrower region on the wiring unit and essentially locked inside of the housing of the wiring unit.

One of the numerous advantages of this type of connection system is that both the wiring unit and the functional unit are easily connectible to each other such that the functional unit and the wiring unit can be simply rotated relative to each other to move from an unlocked to a locked position, or rotated back to move from a locked to an unlocked position.

When the functional unit and the wiring unit are coupled together, the locking flanges on the wiring section rotate around and snap underneath the locking flanges on the functional unit. On the wiring unit, at least one of the flanges is in the form of a lead flange which has a curved leading edge which interacts with a flange on the functional unit which acts as a latch release tab.

The latch release tab is in the form of a movable leaf spring which can be pushed back via the rotational interaction of the curved leading edge of the lead flange on the wiring unit. The lead flange on the wiring unit also includes a locking projection in the form of a lip or flange which extends substantially perpendicular to the extension of the body of the lead flange. When the wiring unit is rotated into a locked position, this locking projection snaps past the latch release tab and then forms a rim locking the wiring unit in place. To release the wiring unit from the functional unit, the latch release tab is pulled back away from the body of the wiring unit, releasing the locking projection, which then allows the wiring unit to rotate back around and then release from the functional unit.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 3A is a perspective view of the interior components shown in the wiring unit shown in FIG. 2B;

FIG. 3B is a perspective view of one of the interior components in the wiring unit in FIG. 2B;

FIG. 3C is a perspective view of another one of the interior components shown in FIG. 3A;

DETAILED DESCRIPTION

Figure 1:
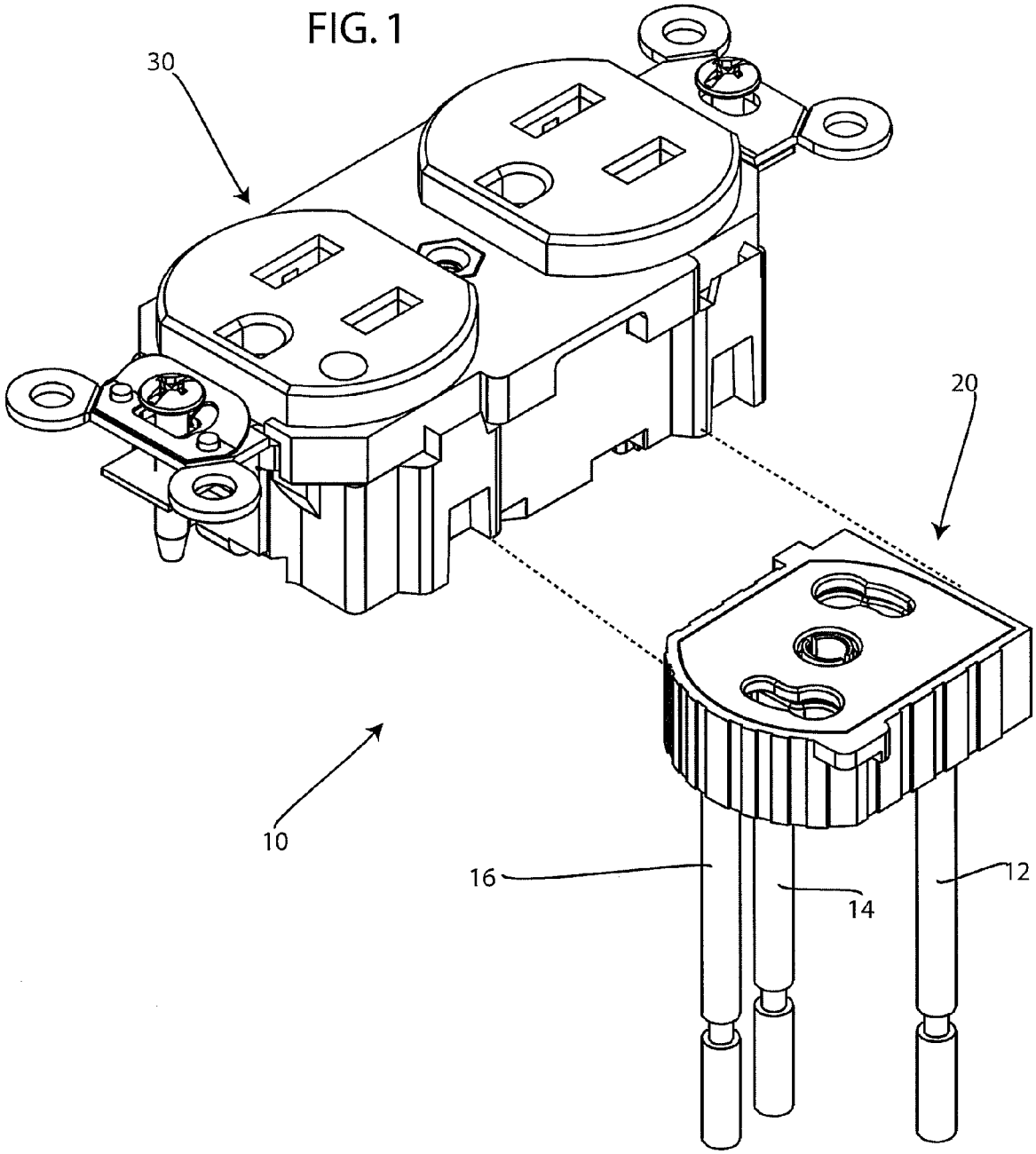
FIG. 1 is a perspective view of a first embodiment of the device including a wiring unit and a functional unit.

Referring to the drawings, FIG. 1 is a front perspective view of a first embodiment of a device 10 comprising a wiring module or unit 20, and a functional unit 30. Wiring unit 20 is coupled to wires 12, 14, and 16. In this example, wire 12 is a hot or phase line, serving as a power input line, wire 14 is a ground line, while wire 16 is a neutral line.

Figure 2A:
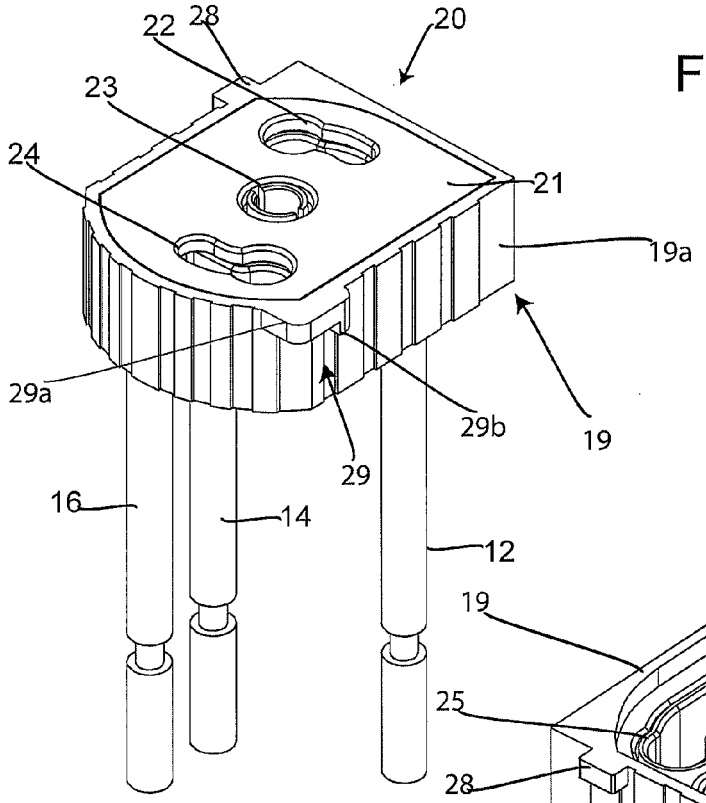
FIG. 2A is a front perspective view of a first embodiment of the wiring unit.

FIG. 2A is a front perspective view of wiring or connecting unit 20 which can be coupled to functional unit 30 as shown in FIG. 1. In this view, there is shown a body 19 having a perimeter region 19*a*, a front face 21 and functional interactive elements 22, 23 and 24. Opposite functional face 21 are three wires 12, 14 and 16 which pass through the back end of wiring or connecting unit 20. There are also tabs or flanges 28 and 29 which are coupled to base body 19 (see FIG. 4A). These tabs or flanges 28 and 29 are disposed in opposite corners from each other and are used to assist in locking the wiring unit to the functional unit. Flange 28 is in the form of a substantially rectangular flange, while flange 29 is a lead flange and includes a body section 29*a* and a locking projection 29*b* which extends substantially perpendicular to the body section 29*a*.

Figure 2B:
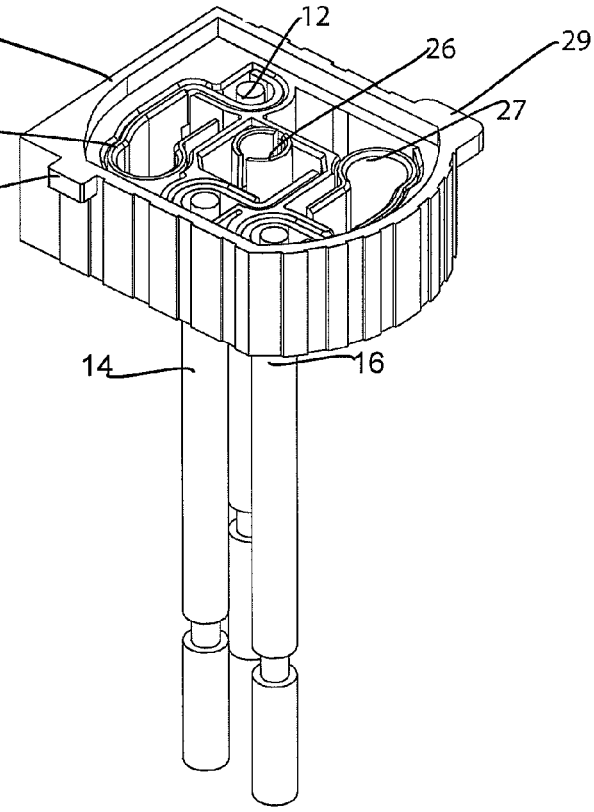
FIG. 2B is a front perspective view of an open face on the wiring unit.

FIG. 2B discloses a front perspective open view of wiring unit 20. In this view, there is shown a central shaft 26 disposed inside of body 19 for receiving a ground pin. In addition, there is also shown wiring connectors 25 and 27 which are disposed in body 19 and are each respectively coupled to hot wire 12 and neutral wire 16. In addition, central shaft 26 is electrically coupled to ground wire 14.

FIGS. 3A-C disclose wiring connectors 25, 26 and 27. For example wiring connector 25 is for connecting to wire 12, while wiring connector 27 is for connecting to wire 16 while wiring connector 26 is for connecting to wire 14. Wiring connector 25 includes a body section 25*a* and a narrower connecting region or locking region 25*b*. There is also a wire contact region 25*c* and a wire insulation connection region 25*d* (not shown). Body section 25*a* is a rounded region for receiving a locking device; in this case a connecting prong or a locking pin would insert into an open wider body section 25*a* and rotate down into a narrower or smaller locking region 25*b*. Wire contact region 25*c* can be crimped onto an open exposed wire such as a phase wire, which allows electrical current to flow through. The wire insulation connection region can be used crimp on to the insulated part of the wire.

In addition, there is also a corresponding wire connector 27 which includes a body section 27*a*, a locking region 27*b*, wire contact region 27*c*, and a wire insulation connection region 27*d*. Body section 27*a* includes a wider rounded region for receiving any form of a locking device. In this case the locking device would be a locking pin, which would insert into body section 27*a* and then rotate down into a narrower or smaller locking region 27*b*. In addition, wire contact region 27*c* can be crimped onto an open exposed wire such as wire 16. In addition, a wire insulation connection region 27*d* can be crimped onto the body of the shielded part of the wire as well.

There is also shown wiring connector 26, which includes a body section 26*a* for receiving a ground pin. There is also a terminal section 26*b* and a wire connection section 26*c* which can be crimped onto a wire such as a ground wire 14. These three wire connectors 25, 26, and 27 can be made from an electrically conductive material such as a metal.

Figure 4A:
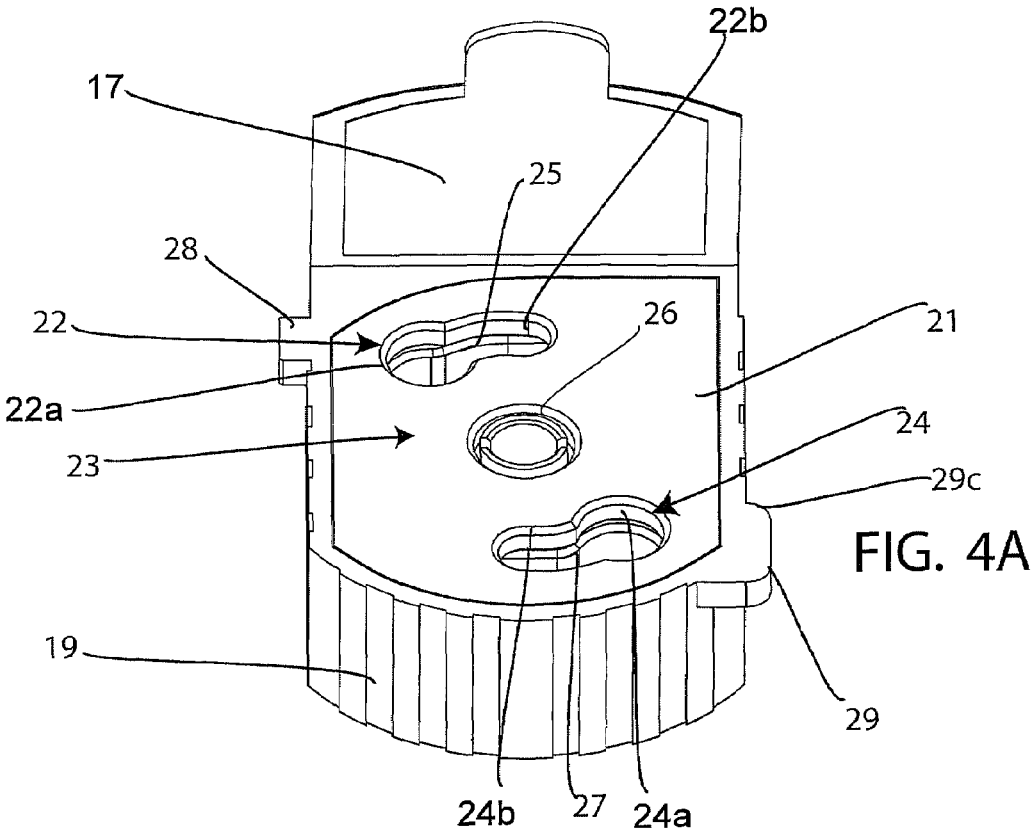
FIG. 4A is a perspective view of another embodiment of the wiring unit.
Figure 4B:
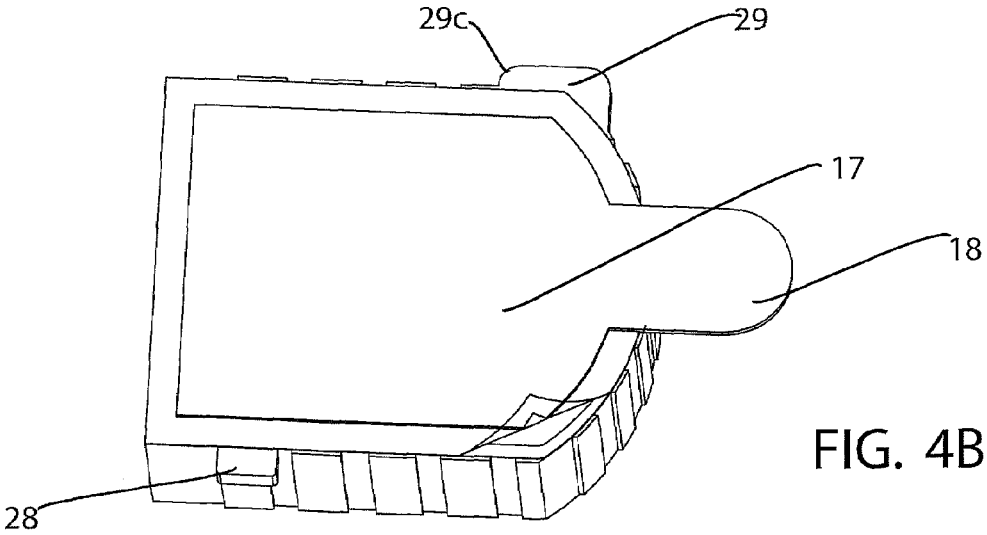
FIG. 4B is a perspective view of the embodiment shown in FIG. 4A with the cover closed.

FIG. 4A discloses a front perspective view of wiring unit 20 which includes base or body 19 front face 21 and functional interfaces 22, 23 and 24. In this case, there is shown a functional interface 22 having a receiving region 22*a* and a locking region 22*b*. In addition, functional interface 24 has a receiving region 24*a* and locking region 24*b*. These regions correspond with the respective body wiring connector section 25*a* and locking region 25*b* and body section 27*a* and locking region 27*b* (See FIG. 3A). There is also a removable cover 17 which can be made from a film type material having an adhesive for allowing the selective removal of this cover. As shown in FIG. 4B, removable cover 17 includes a tab 18, which allows a user to grip and remove cover 17. Cover 17 may optionally contain a region which may allow for pre-printing or manual writing for identification purposes such as circuit or other identification. FIGS. 4A and 4B both show flanges 28 and 29 wherein flange 29 is shown as having a curved leading edge 29*c*.

Figure 5A:
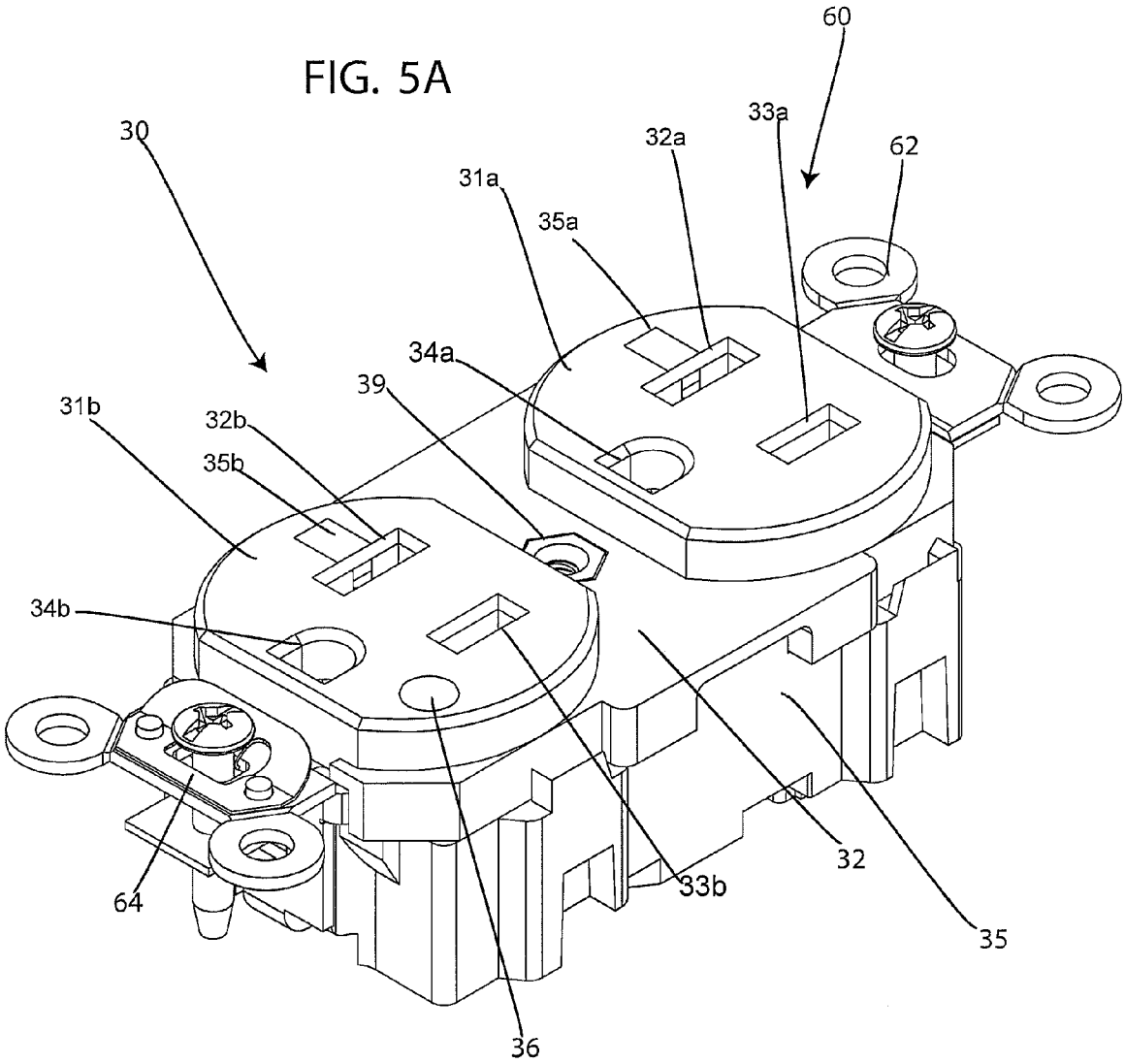
FIG. 5A is a front perspective view of the functional unit shown in FIG. 1.

As shown in FIG. 5A, there is a functional unit or receptacle 30 which includes a housing including a front face plate 32, and a body section 35. There is also a strap 60 including strap elements 62 and 64 extending out from both ends of the housing. Front face plate 32 includes plug blade openings 32*a*, 33*a* and ground pin opening 34*a* in a first outlet 31*a*. Blade opening 32*a* can also be designed to include an additional optional slot 35*a*. In addition, there are also prong openings 32*b*, 33*b* and also ground pin opening 34*b* in second outlet 31*b*. Blade opening 32*b* can also be designed to include optional slot 35*b*. Disposed in second receptacle 31*b* can be a LED light indicator 36, which can be used to indicate whether the wiring unit 20 is connected to the functional unit 30. There is also a fastener 39 for securing front plate 32 to base housing 35. Either one of these user accessible interfaces 31*a* or 31*b* can receive a standard plug.

Figure 5B:
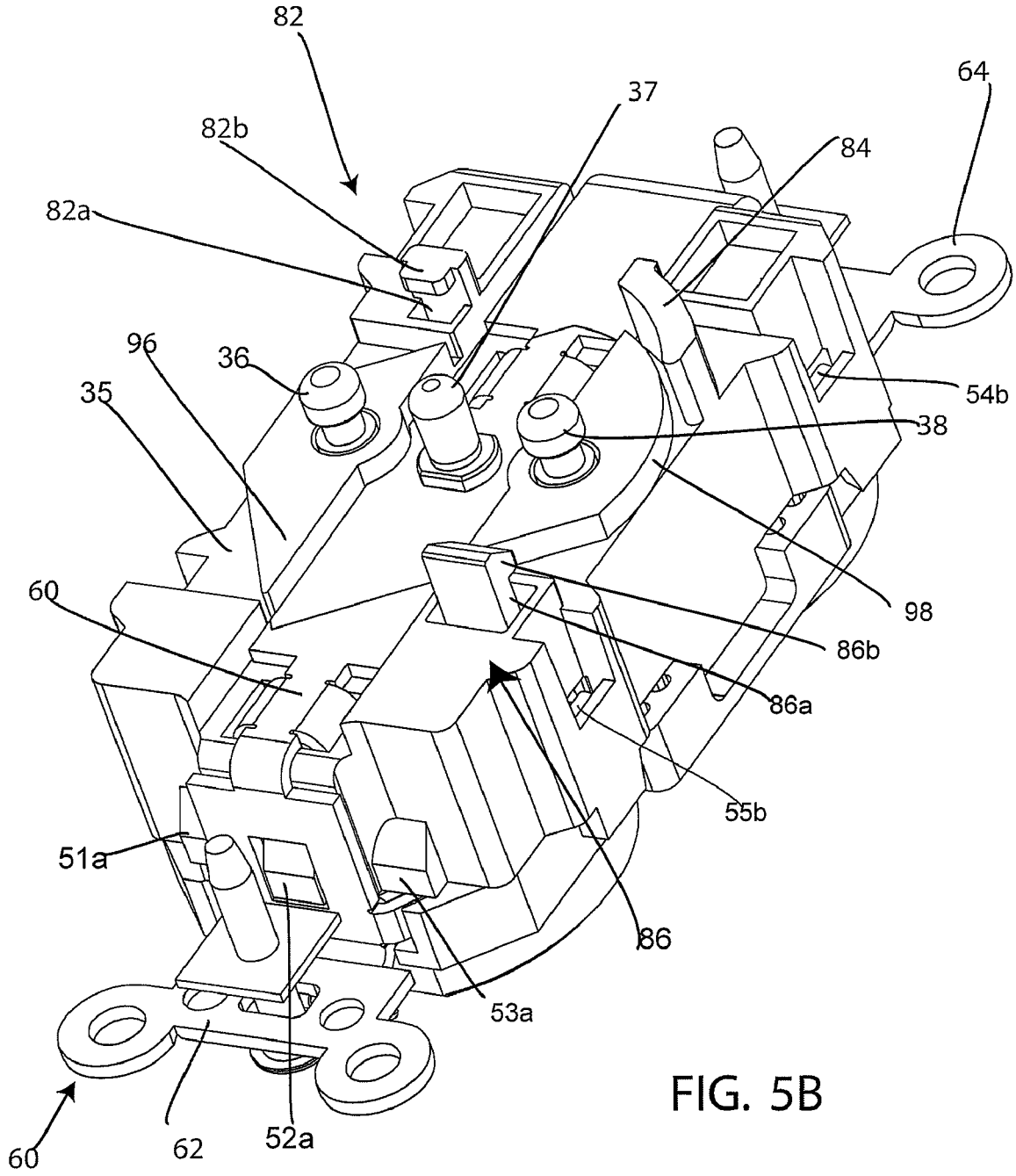
FIG. 5B is a back perspective view of the functional unit shown in FIG. 5A.

FIG. 5B shows a back view of this receptacle unit 30, wherein this receptacle unit is also shown in FIG. 5A. For example in this view there is shown the back end view of body 35 which includes raised connection sections 96 and 98 which can be used to allow the front face of wiring unit 20 to slide and rotate across the outer surfaces of body 35. Also, raised connection sections 96 and 98 provide the user with a visual indication of how to orient the wiring unit 20 for proper connection to the functional unit 30. The outer edges of raised connection sections 96 and 98, along with lines on the back surface of the strap 60 form the approximate shape of the wiring unit 20 in the correct orientation for connecting to functional unit 30. In addition, these sections include gaps disposed between a plurality of connection brackets 82, 84, and 86. First connection bracket 82 is in the form of an L-shaped connection bracket or locking flange, which includes a first extending component 82*a* extending out from the back face of body 35. The second extending component 82*b* is in the form of an overhang, which extends in a position substantially perpendicular to the first extending portion and extends parallel to an approximate plane formed by the back face of body 35. This first connection bracket acts as a fixed latch tab, which is formed integral with body 35 and is used to couple or lock down a corresponding flange 28 on wiring unit 20.

Second connection bracket 84 is in the form of a curved connection bracket which is disposed adjacent to connection section 98. This portion is curved to facilitate or guide the rotation of a side body section 19 of wiring module 20 once the wiring module 20 is in its initial coupling position with functional unit 30. Additionally, this connection bracket 84 is also in the form of a rejection post which is used to key the wiring unit to the proper polarity. With this rejection post, a user could not connect the wiring unit 20 to a functional unit with reverse polarity because if a user tried to insert the wiring unit 20 in an improper manner, it would hit or interact with rejection post 84 before properly connecting to the functional unit 30.

Third connection bracket 86 is also in the form of a locking flange and includes a first extending section 86*a* which extends out from the back face of the base 35 and an overhang or hook 86*b* which extends out substantially perpendicular to this first extending section 86*a*. This connection bracket 86 functions as a latch release tab and which is movable laterally to receive the associated rotating flange 29 on the wiring unit 20.

This view also shows strap 60 having end 62 and 64 and also connection elements 51*a*, 52*a*, 53*a*, 54*b* and 55*b* for coupling base 35 to face 32. There are also connection elements or prongs 36, 37 and 38, which can be used to allow functional unit 30 to connect to wiring unit 20.

Figure 5C:
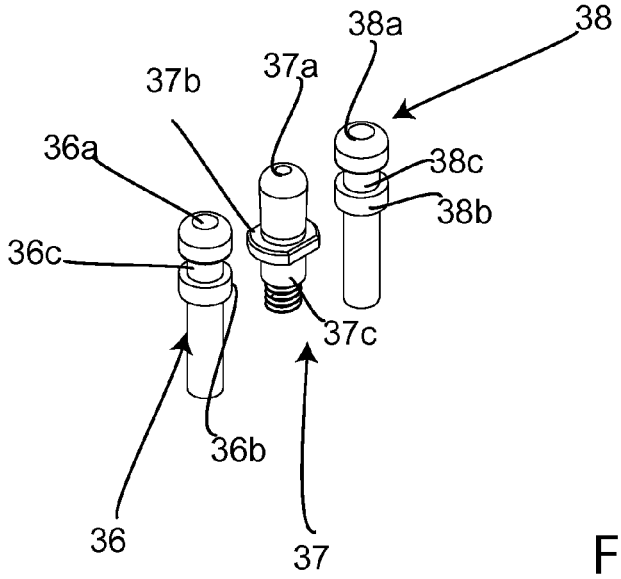
FIG. 5C is a perspective view of the connecting prongs shown in FIG. 5B.

FIG. 5C shows a perspective view of the connecting prongs or locking pins 36, 37 and 38. Locking pin 36 includes a first bulb section 36*a*, a second annular ring section 36*b* and a base section 36*c* which extends on both sides of ring section 36*b*. In addition, locking pin 38 includes a bulb section 38*a*, an annular ring section 38*b* and a base section 38*c* which extends on both sides of ring section 38*b*. Essentially, bulb sections 36*a*, and 38*a* each along with ring sections 36*b*, and 38*b* respectively form a channel in base sections 36*c* and 38*c* disposed between the sections.

When bulb sections 36*a* and 38*a* are inserted into a wiring unit, bulb sections 36*a* and 38*a* engage initial openings 22*a* and 24*a* respectively (See FIG. 4A). Once these bulb sections 36*a* and 38*a*, respectively have been inserted into the body of wiring unit 20, wiring unit 20 can then be rotated. Upon the occurrence of this rotation, these connection pins or prongs 36 and 38 rotate within these channels such that bulbs 36*a* and 38*a* slide underneath the narrower sections 22*b* and 24*b* and also inside narrower channels 25*b* and 27*b* shown in FIGS. 3A and 3C. Rotation of the wiring unit clockwise with respect to functional unit locks the wiring unit to the functional unit. Once the two units are locked together, a counterclockwise rotation will unlock the two units (if the latch release is activated) and allow for their separation. The direction of rotation to lock or unlock the two units is intuitive to the end-user as a clockwise rotation is generally recognized as turning a device ON and counterclockwise is generally recognized turning a device OFF (such as with a valve, tightening a fastener, or assembling locking electrical connectors commonly used in the electrical industry).

Once this rotation has been completed, these prongs are locked therein such that bulbs 36*a* and 38*a* are now disposed underneath front faceplate 21, inside the narrower channels 22*b* and 24*b*. In addition, upon this rotation, locking flanges 28 and 29 connect or interact with locking flanges 82, 84, and 86 to lock wiring unit 20 to functional unit 30. Locking flange 82 is in the form of a fixed latch tab, while locking flange 86 is in the form of a latch release tab, that acts as a leaf spring. For example, in this way, locking flanges 28 and 29, which form extensions extending out from body 19 slide underneath laterally extending regions 82*b* and 86*b*. Because locking flange 86 is in the form of a latch release tab, once a leading edge 29*c* of locking flange 29 contacts latch release tab 86 it drives or snaps latch release tab 86 back allowing latch 29 to pass underneath this locking flange 86. Locking projection 29*b* on locking flange 29 has an inside face that is now in contact with an inside face 86*c* (See FIG. 6A) of locking flange 86 locking the wiring unit 20 against rotation. Once these flanges 28 and 29 slide underneath these overhangs, and once bulbs 36*a* and 38*a* are locked inside of housing 19, the wiring unit 20 is then locked to functional unit 30 in a secure manner. This is because overhangs 82*b* and 86*b* lock into locking flanges 28 and 29 and keep wiring module 20 locked into functional unit 30.

To unlock wiring unit 20 from functional unit 30, a user can then pull back on locking flange 86 and then rotate wiring unit 20 in a counter clockwise manner allowing locking flange 29 to pass underneath overhang 86*b* and rotate into a releasable position.

Figure 6A:
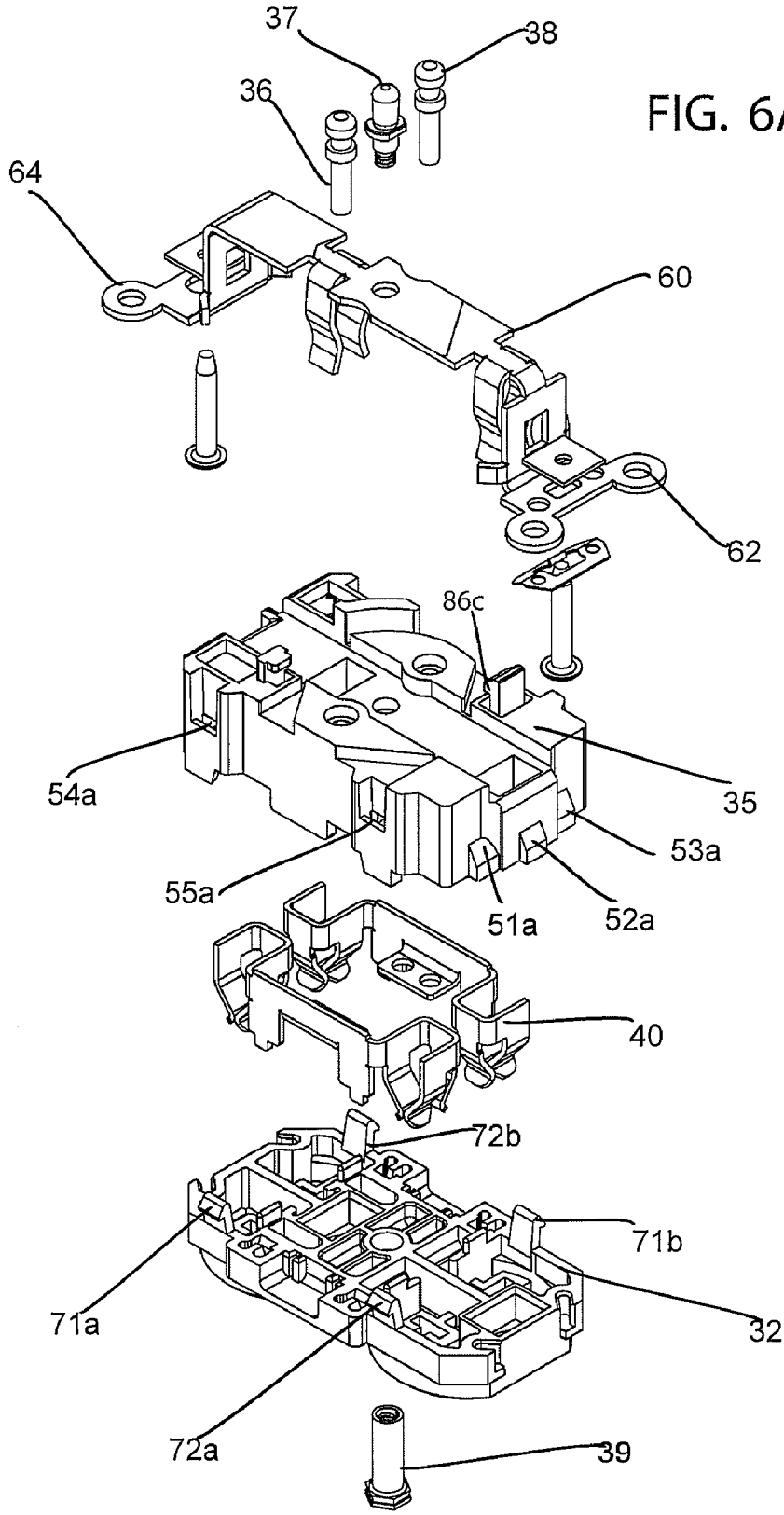
FIG. 6A is a back perspective exploded view of the functional unit.
Figure 6B:
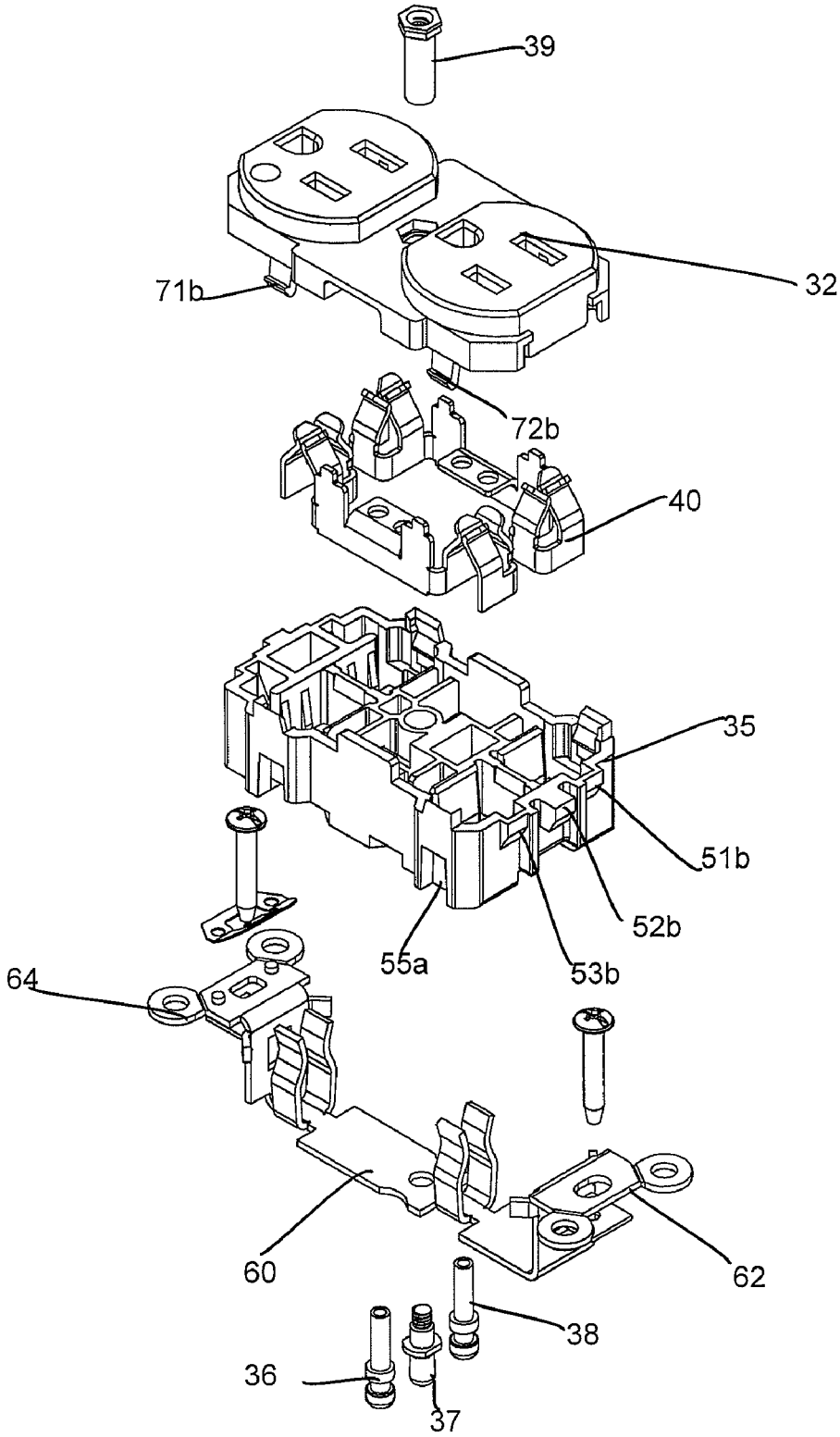
FIG. 6B is a front perspective exploded view of the functional unit shown in FIG. 6A.

FIGS. 6A and 6B disclose a back perspective exploded view and a front perspective exploded view respectively of a functional unit which is the same or similar to that shown in the first embodiment. In both of these views, there is shown a front face plate 32 which is connected to base or housing block 35. Receptacle contacts 40 are disposed between front plate 32 and base block 35. Strap 60 is coupled to a back of base block or base housing 35.

There are a plurality of connecting prongs, or pins 36, 37, and 38. Connection pins 36 and 38 are respectively for making connection to a phase and a neutral of the electrical supply. Connection pin 37 is for connecting to a ground. Base housing block 35 includes flange or end connection elements 51*a*, 52*a*, and 53*a*. In addition, there are also opposite side or also flange or end connection elements 51*b*, 52*b*, and 53*b*. There are also side connection elements 54*a* and 55*a* shown in FIG. 6A and also side connection elements 54*b* and 55*b* (See FIG. 5B).

Front face plate 32 includes side connection clips 71*a*, 72*a* and oppositely spaced connection clips 71*b* and 72*b*. These connection clips are adapted to interact with side flange elements 54*a* and 55*a* on a first side and 54*b* and 55*b* on the opposite side (See FIG. 5B).

Thus, when front face plate 32 snaps down on base housing block 35 these clips snap into the side flanges, thereby locking contacts 40 inside of the housing. FIG. 5A discloses the perspective view of functional unit 30, which has been assembled in its final condition. In addition, FIG. 5B discloses a back perspective view of the device in assembled condition.

Figure 7:
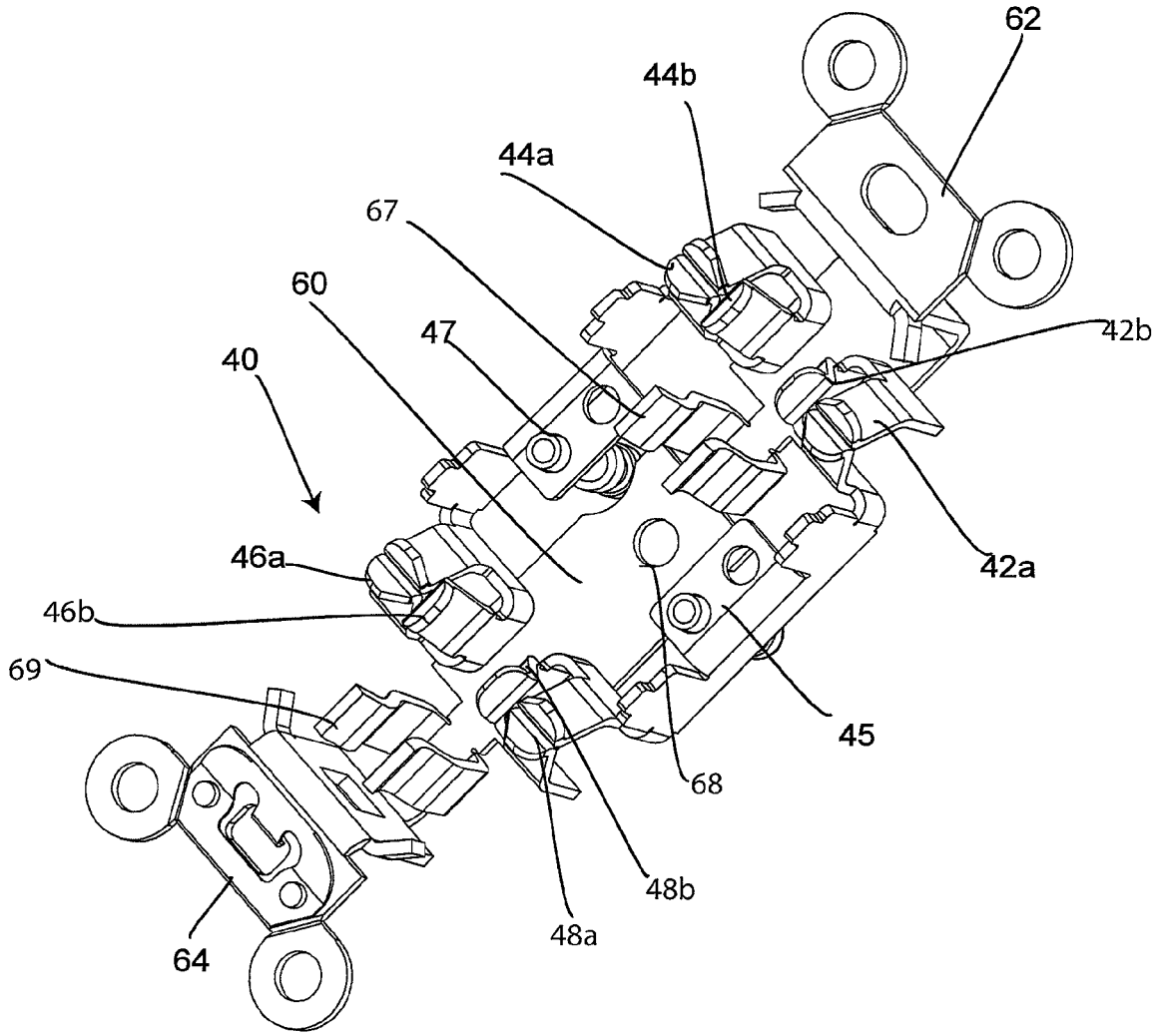
FIG. 7 is a front view of the strap and additional components shown in FIG. 6A and FIG. 6B.

FIG. 7 discloses a front perspective view of contacts 40 and strap 60 of functional unit 30. Contacts 40 can be in the form of an electrically conducting material. Contacts 40 include prong interfaces 42*a*, 44*a*, 46*a*, and 48*a*, and side prong interfaces 42*b*, 44*b*, 46*b*, and 48*b*. These prong interfaces are for receiving prongs from an electrical device such as a plug. In addition, contacts 40 are also connected to, or formed continuous with prongs or connecting elements 36 and 38 (not shown). Contacts 40 can be disposed at least partially inside of a base housing 35 which is made of a electrically insulating material such as a thermoset or a thermoplastic compound. Base housing 35 is coupled to front face plate 32, on a front end, and is coupled on a back end to strap 60. One example of a strap is strap 60 which includes strap extensions 62 and 64. In addition, strap 60 also includes strap prongs 67 and 69 for connecting into openings in body 35. Strap 60 also includes a hole 68 for receiving a ground connection pin 37, which extends out to a back end of strap 60. Connection pin 37 threads into female threads within fastener 39 (See FIG. 6A or 6B) to establish a ground path and also to aid in securing the functional unit together.

Figure 8B:
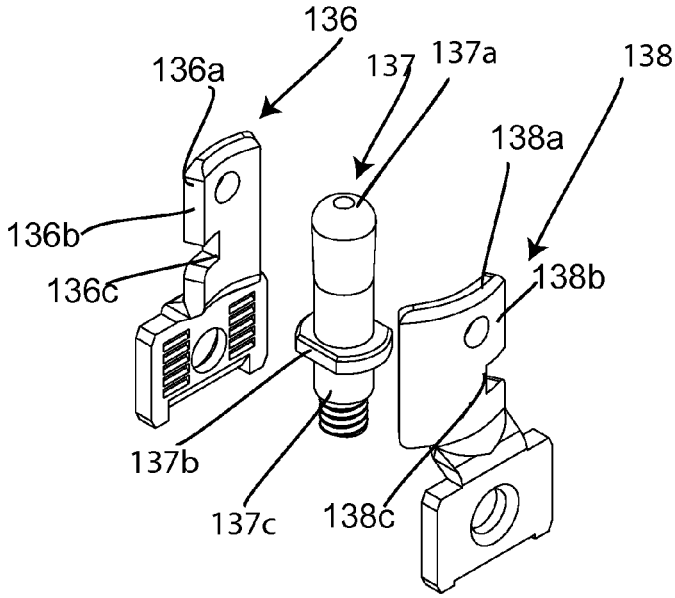
FIG. 8B is a perspective view of the connecting prongs shown in FIG. 8A.
Figure 8A:
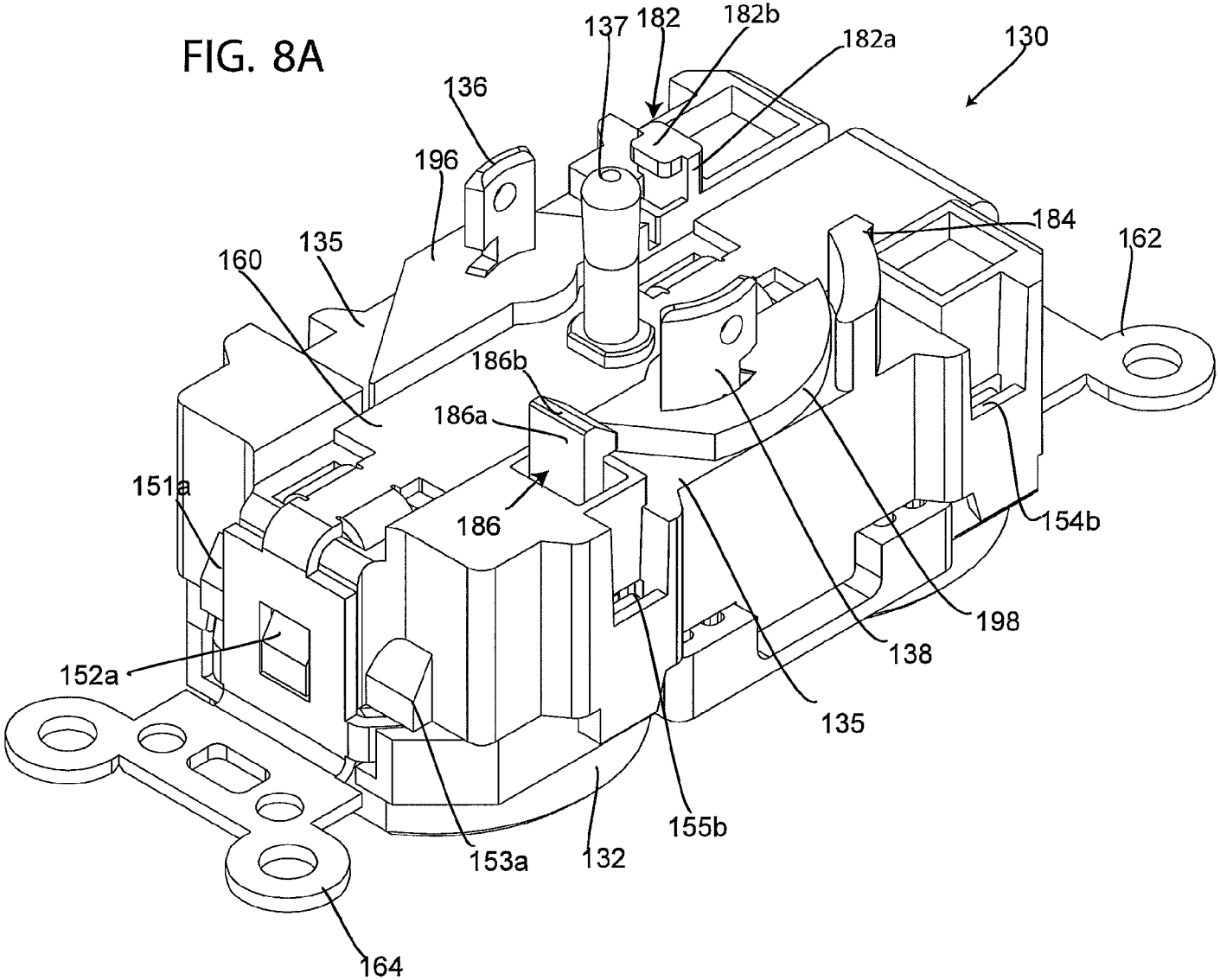
FIG. 8A is a back perspective view of a second embodiment of the functional unit.

FIG. 8A is a perspective view of a second embodiment of the invention. In this view, a second embodiment of functional unit 130 is shown. This functional unit 130 has a front face plate 132 and a body 135. There are also prongs 136 and 138 and a central ground pin shaft 137 extending out from body 135. Prongs 136 and 138 are shown in greater detail in FIG. 8B. There is also a strap 160 which has strap extensions 162 and 164 extending out therefrom. This body 135 also contains a plurality of flanges which form connection elements, which can be used to allow additional elements such as a front face plate 132 or strap 160 to connect thereto. These flange elements can be in the form of snap locking element 151*a*, which locks front face plate 132 to body 135, locking elements 152*a*, and 153*a* which lock strap 160 to the body 135. In addition, there is shown locking flange 154*b*, and 155*b*, which is coupled to front face plate 132 and allows front face plate 132 to couple to body 135.

There are also locking flanges 182, 184, and 186 coupled to body 135. Locking flange 182 includes a first section 182*a*, which includes a section extending perpendicular out from a back face of body 135. There is also an overhang region 182*b*, which extends substantially perpendicular to extension element 182*a*. This locking flange is in the form of a fixed latch tab. There is also locking flange 184, which extends in a substantially circular manner around connection plate 198, which functions as a locking post to force the wiring unit to connect with proper polarity. Finally there is also another locking flange in the form of a catch or lock 186, which extends up and out from body 135 and also includes an extending section 186*a* and a catch or overhang 186*b* for catching flange 129 shown in FIG. 9. This lock or latch 186 acts as a latch release tab similar to latch release tab 86 described above.

Figure 9:
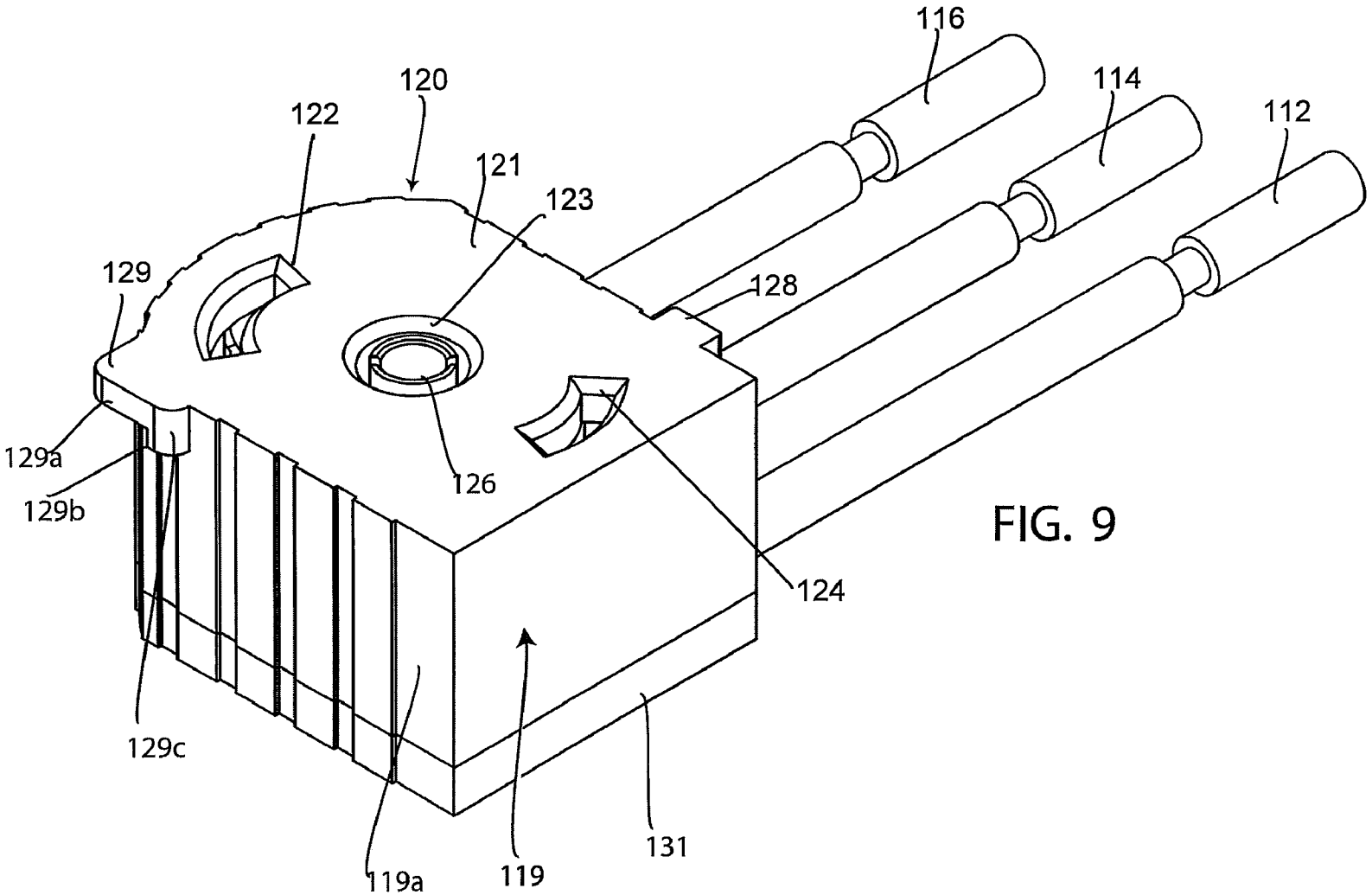
FIG. 9 is a perspective view of another embodiment of the wiring unit.

Connection surfaces 196 and 198 are designed for receiving a front face 121 of wiring unit 120 shown in FIG. 9. In this view, there are a plurality of connection wires 112, 114, and 116 which can be in the form of a hot wire 112, a ground wire 114, and a neutral wire 116. In addition, this wiring unit 120 can include a body section 119 having a perimeter region 119*a* extending around this body section and a front face 121 having a first prong opening 122, a second prong opening 124 and a ground pin opening 123. Ground pin opening 123 includes space for a cylinder 126 for receiving ground pin 137. In addition, openings 122 and 124 are designed for receiving prongs 138 and 136 respectively.

Prongs 136 and 138, which are shown in greater detail in FIG. 8B include a first section 136*a*, which is an initial contact region. A second body section 136*b* includes a hole, wherein this body section then narrows to a narrow or smaller section 136*c*. In addition, prong 138 includes an initial connection region 138*a*, the second body section 138*b* having a hole and a third narrow or smaller region 138*c*. These narrow regions 136*c* and 138*c* are designed to form catches such that when the wiring unit 120 is coupled to the back surface of housing 135, these prongs, arms, or branches 136 and 138 slide into openings 122 and 124 such that once connection element 120 is rotated, a flange (not shown but disposed inside of the housing) locks into narrower openings in regions 136*c* and 138*c* to lock these prongs therein.

Figure 10:
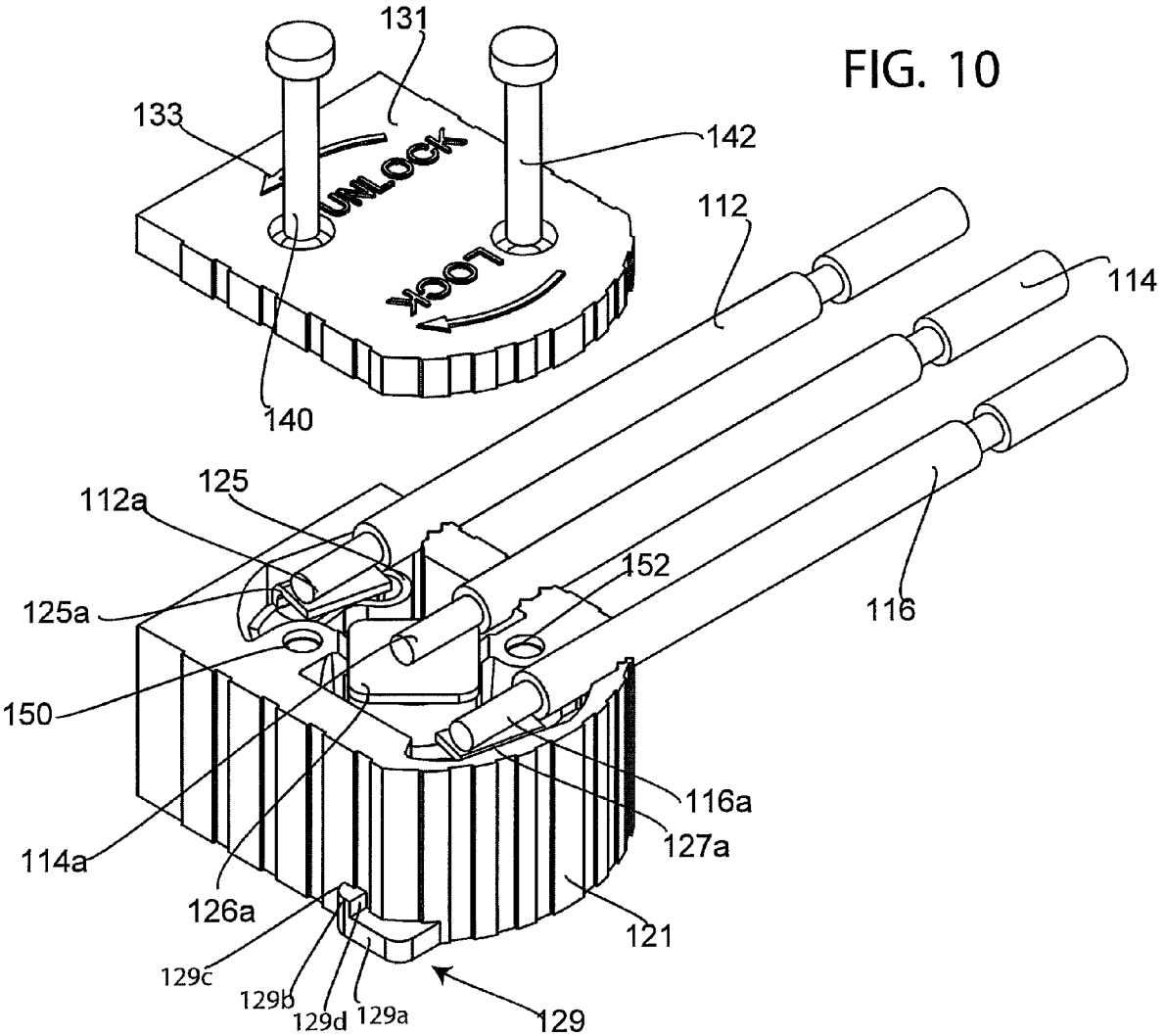
FIG. 10 is an open semi-exploded view of the wiring unit shown in FIG. 9.

FIG. 10 discloses the backside view of the embodiment shown in FIG. 9. In this view, there is shown wiring unit 120 which includes body section 121 and back plate 131 which is coupled to body section 121 via fasteners 140 and 142 which are insertable into holes 150 and 152 on body section 121. A plurality of wires 112, 114, and 116 having respective exposed ends 112*a*, 114*a*, and 116*a* are shown coupled to electrical contacts 125*a*, 126*a*, and 127*a* which lead to respective open contacts on the opposite face (See FIG. 9). Disposed on back face 131 can be writing or indicia 131 setting forth a set of instructions to a user on how to connect wiring unit 120 to functional unit 130.

When wiring unit 120 is coupled to functional unit 130, locking flanges 128 and 129 interact with locking flanges 182, 184, and 186 to form a secure connection. For example, as wiring module 120 is rotated in a clockwise manner, the leading edge 129*c* which is formed with a curved interface rotates into locking flange 186 formed as a leaf spring or latch release tab. This rotational movement drives locking flange 186 back and allows locking flange 129 underneath overhang 186*b*. In the fully rotated and locked position, locking projection 129*b* has rotated past locking flange 186 such that inside face 129*d* of locking projection 129*b* is now in contact with an inside face of locking flange 186. To unlock wiring unit or wiring module 120 from functional module 130, latch release tab or locking flange 186 is pulled back so that locking flange 129 can now pass underneath overhang 186*b* wherein as wiring module 120 continues to rotate past locking flange 186, it can then be moved into a release position so that it can be pulled away from functional module 130. Either of the wiring modules 20 or 120 may include additional labels including indicia, which can be used as instructions for connecting the wiring modules and the functional modules together. These labels can be coupled to a top section or a side surface of these wiring modules.

In addition, in each of the embodiments, the two wiring units 20 and 120 and the functional units 30 and 130 can each include rejection elements. These rejection elements can be in the form of flanges such as flanges 28 and 29, or curved connection bracket 84 and 184 which can operate as a rejection post which can be used to intersect with a perimeter of the bodies 19, and 119 of either of the wiring units 20, 120.

The designs of wiring modules 20, 120 and functional modules 30 and 130 are formed so that these devices can be both electrically and mechanically coupled together in a secure manner. In addition both of these embodiments are designed so that the wiring module and the functional module can only be coupled together in one way, so as to prevent against miswiring.

Accordingly, while at least one embodiment of the present invention has been shown and described, it is to be understood that many changes and modifications may be made thereunto without departing from the spirit and scope of the invention as defined in the appended claims.

What is claimed is:

1. A modular wiring system comprising:

a) a functional unit comprising:

i) a housing;

ii) at least one functional interface disposed within said housing;

iii) at least one connection element extending out from said housing, said at least one connection element having a first section and a second section wherein said second section forms a locking section;

b) a wiring unit comprising:

i) a housing having at least one opening; and ii) at least one front face forming a connection interface for said locking section of said at least one connection element wherein said wiring unit housing is smaller than said functional unit housing.

2. The modular wiring system as in claim 1, wherein said at least one connection element is in the form of a substantially cylindrically shaped prong made from electrically conductive material.

3. The modular wiring system as in claim 1, wherein said at least one connection element is in the form of a plate made from electrically conductive material.

4. The modular wiring system as in claim 1, wherein said first section of said at least one connection element is smaller in area than said locking section.

5. The modular wiring system as in claim 1, wherein said locking section is in the form of a locking overhang which can be used to interact with said front face of said housing on said wiring unit to lock said functional unit to said wiring unit.

6. The modular wiring system as in claim 1, wherein said wiring unit further comprises at least one locking flange.

7. The modular wiring system as in claim 6, wherein said wiring unit having at least one locking flange includes at least two locking flanges.

8. The modular wiring system as in claim 1, wherein said functional unit further comprises at least one locking flange.

9. The modular wiring system as in claim 6, wherein said functional unit further comprises at least one locking flange which is used to couple to said at least one locking flange on said wiring unit.

10. The modular wiring system as in claim 9, wherein said at least one locking flange on said functional unit is in the form of a fixed latch tab.

11. The modular wiring system as in claim 9, wherein said at least one locking flange on said functional unit is in the form of a latch release tab.

12. The modular wiring system as in claim 1, wherein said functional unit further comprises at least one raised surface disposed on a back face for allowing said wiring unit to couple to said at least one prong and then rotate on said at least one raised surface.

13. The modular wiring system as in claim 12, wherein said at least one raised surface has a perimeter which indicates to a user a proper orientation of said wiring unit with respect to said functional unit.

14. The modular wiring system as in claim 13, wherein said functional unit, further comprises a rejection element, such that said wiring unit cannot be coupled to said functional unit unless said wiring unit is in said proper orientation with respect to said functional unit.

15. The modular wiring system as in claim 13, wherein said wiring unit further comprises a rejection element, which is adapted so that said wiring unit cannot be coupled to said functional unit unless said wiring unit is in a proper orientation with respect to said functional unit.

16. The modular wiring system as in claim 14, wherein said rejection element comprises a post on said functional unit and said wiring unit has a perimeter, wherein said perimeter of said wiring unit is asymmetrical such that during a connection rotation, said post will interfere with said perimeter of said wiring unit if said wiring unit is not in said proper orientation with respect to said functional unit.

17. The modular wiring system as in claim 1, wherein said wiring unit further comprises at least one removable cover.

18. The modular wiring system as in claim 1, wherein said at least one opening in said housing of said wiring unit comprises a first wider receiving region and a second narrower locking region.

19. The modular wiring system as in claim 14, wherein said at least one connection element on said functional unit is in the form of a locking prong having a narrower base and a wider end portion, and wherein at least one first wider receiving region on said wiring unit is adapted to receive said wider end portion of said locking prong, such that when said wiring unit is coupled to said functional unit, said wider end portion inserts into said at least one first wider receiving region, said wiring unit is rotated relative to said functional unit such that said wider end portion on said locking prong rotates into said second narrower locking region on said wiring unit to lock said functional unit to said wiring unit.

20. The modular wiring system as in claim 15, wherein said wiring unit further comprises at least one cover.

21. The modular wiring system as in claim 20, wherein said cover on said wiring unit, is removable and includes an area for labeling for identification purposes.

22. A modular wiring system comprising:

a) a functional unit;

b) a wiring unit;

c) a system for coupling said functional unit to said wiring unit in a rotational manner, said system comprising at least one flange coupled to said functional unit and at least one flange coupled to said wiring unit such that when said functional unit and said wiring unit are coupled together, they are rotated to form a locking connection between said at least one flange on said functional unit and said at least one flange on said wiring unit.

23. A modular wiring system comprising:

a) a functional unit;

b) a wiring unit;

c) a system for coupling said functional unit to said wiring unit in a rotational manner, said system comprising at least one locking prong comprised of electrically conductive material, wherein when said functional unit is coupled to said wiring unit, said at least one locking prong is both electrically and physically coupled to said functional unit at a first end and to said wiring unit at a second end.

24. The modular wiring system as in claim 1, wherein said housing of said wiring unit comprises a body section and wherein said front face is coupled to said body section, and wherein said wiring unit further comprises a plurality of wiring connectors, disposed inside of said wiring housing and behind said at least one front face.

25. The modular wiring system as in claim 1, wherein said wiring unit further comprises at least one removable cover.

26. The modular wiring system as in claim 1, wherein said housing of said functional unit further comprises a front face and a back face, wherein said at least one connection element extends out from said back face of said housing of said functional unit.

27. The modular wiring system as in claim 22, wherein said functional unit comprises:

a housing and at least one functional interface disposed within said housing;

wherein said at least one flange coupled to said functional unit extends out from said housing, said at least one flange comprises a first section and a second section wherein said second section forms a locking section.

28. The modular wiring system as in claim 27, wherein said first section of said at least one flange extends out from a back face of said housing, and said second section comprises an overhang which extends substantially perpendicular to said first section.

29. The modular wiring system as in claim 23, wherein said functional unit comprises a housing and at least one functional interface disposed within said housing;

and wherein said at least one locking prong is coupled to and extends out from a back face of said functional unit housing and comprises a first section and a second section forming a locking section having a larger cross sectional area than said first section.

* * * * *